US009221062B2

(12) United States Patent
Sieger et al.

(10) Patent No.: US 9,221,062 B2
(45) Date of Patent: Dec. 29, 2015

(54) PROCESS AND APPARATUS FOR DEDUSTING A VAPOR GAS MIXTURE

(71) Applicants: Hermann Sieger, Darmstadt (DE); Christian Binder, Frankfurt am Main (DE); Nikola Anastasijevic, Altenstadt (DE); Andreas Orth, Friedrichsdorf (DE)

(72) Inventors: Hermann Sieger, Darmstadt (DE); Christian Binder, Frankfurt am Main (DE); Nikola Anastasijevic, Altenstadt (DE); Andreas Orth, Friedrichsdorf (DE)

(73) Assignee: ENEFIT OUTOTEC TECHNOLOGY OÜ, Tallinn (EE)

( * ) Notice: Subject to any disclaimer, the term of this patent is extended or adjusted under 35 U.S.C. 154(b) by 75 days.

(21) Appl. No.: 14/351,883

(22) PCT Filed: Oct. 10, 2012

(86) PCT No.: PCT/EP2012/069989

§ 371 (c)(1),
(2) Date: Apr. 15, 2014

(87) PCT Pub. No.: WO2013/057009

PCT Pub. Date: Apr. 25, 2013

(65) Prior Publication Data

US 2014/0290480 A1 Oct. 2, 2014

(30) Foreign Application Priority Data

Oct. 21, 2011 (EP) ..... 11186139

(51) Int. Cl.
*B03C 3/00* (2006.01)

(52) U.S. Cl.
CPC ..... *B03C 3/00* (2013.01)

(58) Field of Classification Search
CPC combination set(s) only.
See application file for complete search history.

(56) References Cited

U.S. PATENT DOCUMENTS 2,013,753 A * 9/1935 Hahn ..... C01B 17/56 95/235
2,311,738 A * 2/1943 Cutler ..... A43B 9/06 36/19.5
3,722,178 A * 3/1973 Aaland ..... B03C 3/013 95/4
3,800,505 A * 4/1974 Tarves, Jr. ..... B03C 3/014 261/116
3,899,308 A * 8/1975 Petersson ..... B03C 3/014 423/153
4,145,191 A * 3/1979 Kunchal ..... B01D 47/06 261/128
4,232,391 A * 11/1980 Zanutti ..... H04B 1/034 340/539.1
4,365,976 A * 12/1982 Frohnert ..... B03C 3/00 208/161

(Continued)

FOREIGN PATENT DOCUMENTS

CA 879669 A 8/1971
DE 19611119 C2 9/1997

(Continued)

OTHER PUBLICATIONS

Xiaohui Han, et al., Progress in Research and Development of Oil Shale Retorting Technology Abroad, Sino-Global Energy, vol. 16, No. 4, p. 75, Apr. 30, 2011.

(Continued)

*Primary Examiner* — Duane Smith
*Assistant Examiner* — Sonji Turner
(74) *Attorney, Agent, or Firm* — Leydig, Voit & Mayer, Ltd.

(57) ABSTRACT

A process for dedusting a dust laden vapor gas mixture (VGM) obtained by pyrolysis of a material containing hydrocarbons includes treating the dust laden VGM in a dry electrostatic precipitator at a temperature in a range from 380 to 480° C. so as to separate dust from the VGM. Then, the VGM is cooled to a temperature in a range from 310 to 360° C.

12 Claims, 3 Drawing Sheets

(56) References Cited

U.S. PATENT DOCUMENTS 4,373,995 A * 2/1983 Bowen ..... C10B 53/02 202/214
4,375,402 A * 3/1983 Durai-Swamy ..... C10B 49/20 208/411
4,548,702 A 10/1985 York et al.
4,696,679 A * 9/1987 Albulescu ..... C10J 3/02 48/197 R
5,282,885 A * 2/1994 Cameron ..... B03C 3/014 95/66
5,300,270 A * 4/1994 Krigmont ..... B01D 53/323 423/235
5,364,457 A * 11/1994 Cameron ..... B03C 3/014 165/104.23
6,036,484 A * 3/2000 Carcer ..... F23G 5/027 110/246
6,294,003 B1 * 9/2001 Ray ..... B03C 3/16 55/DIG. 38
7,998,315 B2 * 8/2011 Bridgwater ..... C10B 53/02 201/2.5
8,043,391 B2 * 10/2011 Dinjus ..... C10B 53/02 48/197 A
8,202,332 B2 * 6/2012 Agblevor ..... C10B 47/24 252/373
8,476,480 B1 * 7/2013 Brown ..... C10K 1/04 201/12
2004/0220285 A1 * 11/2004 Boerrigter ..... C10K 1/18 518/726
2005/0039599 A1 * 2/2005 Johnson ..... B01D 45/04 95/271
2007/0125637 A1 * 6/2007 Merrell ..... B01J 6/004 202/92
2008/0236043 A1 * 10/2008 Dinjus ..... C10B 53/02 48/197 R
2009/0165378 A1 * 7/2009 Agblevor ..... C10B 47/24 48/127.7
2009/0227766 A1 * 9/2009 Bridgwater ..... C10B 53/02 530/202
2010/0212215 A1 * 8/2010 Agblevor ..... C10B 53/02 44/300
2010/0216898 A1 * 8/2010 Tonseth ..... C10B 49/04 518/703
2010/0263487 A1 * 10/2010 Orth ..... C10B 49/10 75/477
2011/0030235 A1 * 2/2011 Brancuzsky ..... F23G 5/46 34/384
2012/0304540 A1 * 12/2012 Hulteberg ..... C10K 1/046 48/128

FOREIGN PATENT DOCUMENTS

EP 0049325 A2 4/1982
FR 2897281 A1 8/2007
WO WO 0030755 A2 6/2000

OTHER PUBLICATIONS

Chinese Office Action, State Intellectual Property of the People's Republic of China, Aug. 25, 2015, pp. 1-12.

* cited by examiner

PROCESS AND APPARATUS FOR DEDUSTING A VAPOR GAS MIXTURE

CROSS-REFERENCE TO PRIOR APPLICATIONS

This application is a U.S. National Phase Application under 35 U.S.C. §371 of International Application No. PCT/EP2012/069989, filed on Oct. 10, 2012, and claims benefit to European Patent Application No. EP 11186139.9, filed on Oct. 21, 2011, The International Application was published in English on Apr. 25, 2013 as WO 2013/057009 A1 under PCT Article 21(2).

FIELD

The present invention is directed to a process and an apparatus for dedusting a dust laden vapor gas mixture obtained by the pyrolysis of preferably solid material containing hydrocarbons, in particular oil shale.

BACKGROUND

In order to obtain oil from oil shale, the oil shale is directly heated by a hot heat carrier (ash) to a temperature of about 500° C. in a rotary kiln. Hereby, oil evaporates from the oil shale forming the so called vapor gas mixture (VGM). The vapor gas mixture (a gas containing also fine particles) is then quenched in a condensation unit for winning the oil. This oil contains particulate material (fines), which are very hard to separate from the oil and prevent a further improvement of its quality due to e.g. catalyst deactivation. Traditionally, such separation has been done by using a scrubber. The dust particles collected by droplets produced in the scrubber can be found in the cooled oil at the scrubber bottom. If a venturi scrubber is used, there is a high pressure loss, which requires corresponding high pressures in the rotary kiln and thereby increases the equipment costs. Further, dust laden heavy oil is recycled to the pyrolysis zone and thus cannot be used directly as a product. The removal of fine dust particles from oil is a very expensive procedure and a technical challenge which has not yet been completely solved.

According to U.S. Pat. No. 4,548,702 A raw oil shale is fed into a specified surface retort followed by solid heat carrier material at 1000 to 1400° C. The withdrawn product stream is partially dedusted in a cyclone or filter. Further dust is removed in a fractionator, scrubber or quench tower. The oil fraction then is fed into a hydroprocessor followed by a catalyst and hydroprocessing gas. The dust removed from the oil fraction and the water stream of sludge containing the dust is used together with the retorted shale as a fuel to heat the heat carrier material and to retort the raw oil.

From document DE 196 11 119 C2 a process for purifying hot waste gases containing dust and tar and obtained during the production of calcium carbide in an arc furnace is known, which comprises dedusting the waste gas at 200 to 900° C. using a ceramic filter and subsequently removing the tar at 50 to 200° C. using a gas scrubber or electro filter. At such temperatures substantial condensation of heavier oil fractions would have to be expected so that this process is not suitable for dedusting VGM.

SUMMARY

In an embodiment, the present invention provides a process for dedusting a dust laden vapor gas mixture (VGM) obtained by pyrolysis of a material containing hydrocarbons. The dust laden VGM is treated in a dry electrostatic precipitator at a temperature in a range from 380 to 480 ° C. so as to separate dust from the VGM. Then, the VGM is cooled to a temperature in a range from 310 to 360° C.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
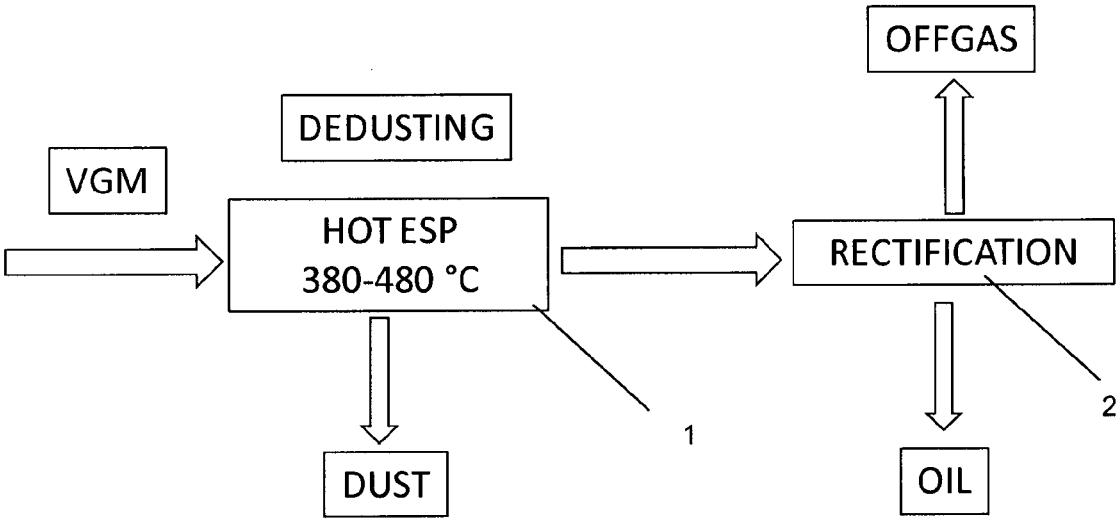
FIG. 1 is a schematic view of an apparatus according to a first embodiment of the present invention.

In an embodiment, the present invention provides for a more efficient production of oil from oil shale or the like. In particular, the removal of dust from the vapor gas mixture obtained by pyrolysis can be optimized.

According to an embodiment of the present invention there is provided a process, wherein the dust laden vapor gas mixture is treated in an electrostatic precipitator (ESP) at a temperature of 380 to 480° C. to separate dust from the vapor gas mixture. The electrostatic precipitator is operated in a dry state at a temperature above the condensation temperature of the oil so that the dust is separated without any condensation of oil. This substantially reduces the contamination of the product (pyrolysis oil). This is particularly important for the subsequent oil upgrading requiring oils having very low dust loads.

An electrostatic precipitator (ESP) is a particulate collection device that removes particles from the VGM using the force of induced electrostatic charge. It, thereby, is a highly efficient filtration device that minimally impedes the flow of gases through the precipitator and can easily remove fine dust particles from the VGM. For implementing the present invention, the electrostatic precipitator may be a tube, plate or chamber precipitator, wherein a tube precipitator is preferred.

It should be noted that instead of oil shale other hydrocarbon containing materials, such as oil sand, biomass, plastics, oil wastes, waste oils, animal fat containing materials, or vegetable oil containing materials may be used for the process of the present invention as long as a vapor gas mixture containing oil can be produced by the pyrolysis of said material. Preferably, the hydrocarbon material contains 8 to 80% by weight of hydrocarbons.

According to a preferred embodiment of the present invention the vapor gas mixture comprises 40 to 90% by weight of $C_{5+}$ hydrocarbons, 4.5 to 40% by weight of $C_{4-}$ hydrocarbons, 0.01 to 30% by weight of non condensable fractions (i.e. gases like $H_2$, $N_2$, $H_2S$, $SO_2$, NO, etc.) and 5 to 30% by weight of water. Preferably, the composition of the vapor gas mixture is as follows: 55 to 85% by weight of $C_{5+}$ hydrocarbons, 7 to 25% by weight of $C_{4-}$ hydrocarbons, 0.1 to 15% by weight of non condensable fractions and 7 to 20% by weight of water, more preferably the composition of the vapor gas mixture is as follows 60 to 80% by weight of $C_{5+}$ hydrocarbons, 13 to 22% by weight of $C_{4-}$ hydrocarbons, 0.3 to 10% by weight of non condensable fractions and 7 to 15% by weight of water.

The dust content of the dust laden vapor gas mixture preferably is 3 to 300 g/Nm$^3$, more preferably 20 to 150 g/Nm$^3$.

In order to improve the dust separation, at least two successive electrostatic precipitators are provided, in which the dust laden vapor gas mixture is treated at a temperature of 380 to 480° C.

As the condensation of oil is substantially avoided, the dust separated in the electrostatic precipitator can be mechanically removed by rapping or vibrating the precipitator.

It is within the present invention to cool the vapor gas mixture to a temperature of 310 to 360° C. subsequent to the treatment in the electrostatic precipitator. Thereby, an extra heavy oil stream can be separated from the VGM by condensation which has an ash content of <80 ppm and can be used as a recycle stream or as product. If the VGM is cooled to room temperature (about 23° C.) all oil fractions of the pyrolysis oil can be condensed.

The cooling preferably is done by indirect cooling with air or water or by injecting additional oil (direct cooling).

In a preferred embodiment of the present invention, subsequent to the cooling step the VGM is treated in a wet electrostatic precipitator at the temperature defined by the cooler, i.e. between 310 and 360° C., or at another temperature suitable to separate the desired oil fraction. In the wet electrostatic precipitator further portions of the heavy or other oil fraction may be separated from the VGM and recycled or used as a product.

Subsequent to the dust removal in the electrostatic precipitator, the cleaned VGM is treated in a rectification device to separate various desired oil fractions. In a preferred embodiment, the cleaned VGM is directed to at least one further electrostatic precipitator where it is treated at a temperature suitable to separate a desired fraction of the oil. Several electrostatic precipitators operating at various temperatures may be successively provided to obtain the desired oil fractions based on their condensation temperature.

Thereby, different low dust product oil fractions are obtained, comprising less than 30 ppm of dust.

An embodiment of the invention also is directed to an apparatus for dedusting a vapor gas mixture obtained by the pyrolysis of a material containing 8 to 80% by weight of hydrocarbons, in particular oil shale, which is suited for performing a process as described above. The apparatus comprises at least one electrostatic precipitator operating at 380 to 480° C.

Preferably, a cooler is provided downstream of the electrostatic precipitator. In a further embodiment, a wet electrostatic precipitator may be provided downstream of the cooler.

Downstream of the dry and/or wet electrostatic precipitator a suitable rectification device may be provided for separating various oil fractions.

In a preferred embodiment the rectification device comprises one or more electrostatic precipitator(s) each in combination with a cooler for adjusting the temperature of the VGM entering the respective precipitator to a value suitable to separate (condense) the desired oil fraction.

In the first embodiment of the present invention as shown in FIG. 1 depicting the basic concept of the invention, a vapor gas mixture (VGM) obtained by the pyrolysis of oil shale or any other suitable material and having a dust content of 3 to 300 g/Nm$^3$ is introduced into a hot electrostatic precipitator 1 operated at a temperature of 380° to 480° C. In the electrostatic precipitator the dust is separated from the oil vapor and settles on the tube walls from where it can be removed by rattling/rapping.

The cleaned (dedusted) oil vapor then is conducted to a rectification device 2, e.g. a standard rectification column, for separating various product oil fractions based on their condensation temperature. The oil fractions may be obtained by standard processes and have a dust content of <30 ppm.

Figure 2:
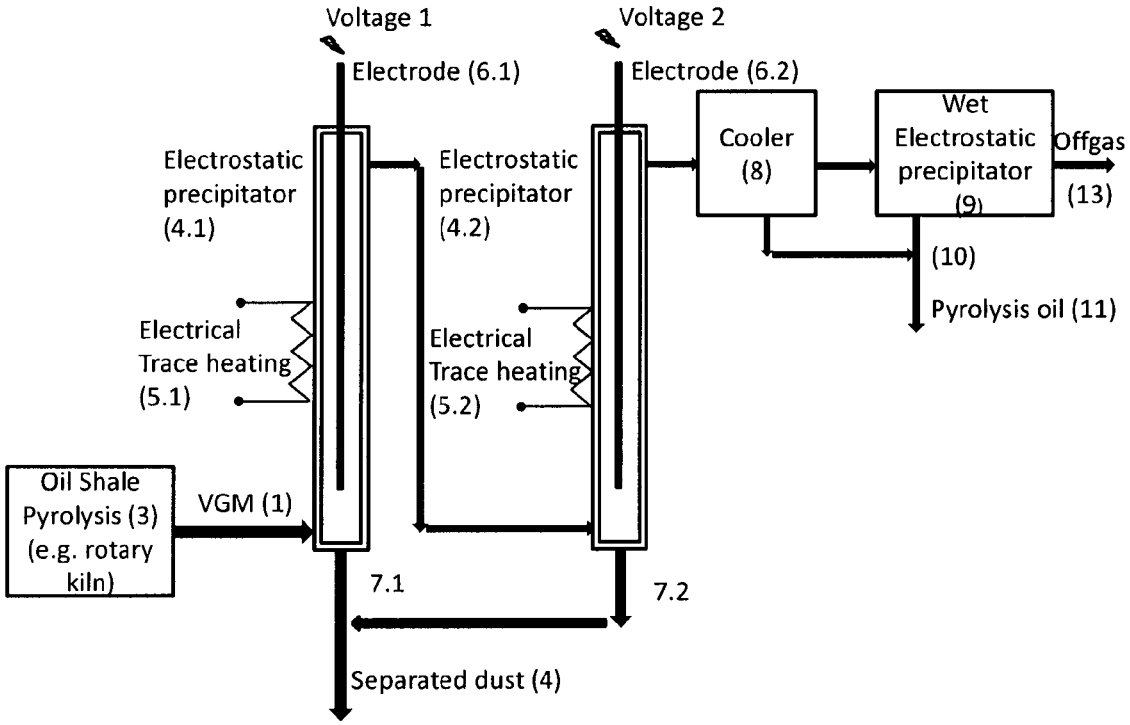
FIG. 2 is a schematic view of an apparatus according to a second embodiment of the present invention.

In the somewhat more detailed embodiment according to FIG. 2 the VGM obtained by oil shale pyrolysis in a rotary kiln 3 or any other suitable pyrolysis device enters a first electrostatic precipitator 4.1. As shown in FIG. 2, two electrostatic precipitators 4.1 and 4.2 are provided in series and successively passed by the VGM. Both electrostatic precipitators 4.1 and 4.2 are operated as dry precipitators at a temperature of 380to 480° C., preferably 400 to 460° C., which basically corresponds to the exit temperature of the rotary kiln 3 and is well above the condensation temperature of the oil so that a condensation even of heavy oil fractions can be avoided. The temperature of the electrostatic precipitators 4.1 and 4.2 is maintained by respective electrical trace heaters 5.1 and 5.2 or any other suitable heating device. By means of electrodes 6.1 and 6.2 a suitable voltage of e.g. 5 kV to 120 kV, preferably 10 kV to 30 kV is provided to separate the dust which is withdrawn through lines 7.

Subsequent to the electrostatic precipitators 4 a cooler 8 is provided to cool the dedusted VGM to a temperature close to the ambient temperature, in particular about 23° C. before the VGM enters a wet electrostatic precipitator 9 also operating at this temperature. The wet precipitator is operated at a temperature below the condensation temperature of hydrocarbons contained in the gas. As the VGM is cooled, small condensed droplets are formed which are dispersed as aerosols in the gas stream. The main part of the condensed droplets is collected at the cooler surface, the droplets remaining in the gas stream, being small enough, pass through the cooler. After charging them via the electrode, they are separated at the counter-electrode. Thereby, the wet electrostatic precipitator precipitates all wet/condensed components from the gas. In the wet electrostatic precipitator 9 the generated oil aerosols are separated so that oil can be withdrawn through line 10. As there already is some condensation of extra heavy oil fractions in the cooler 8 this condensate can also be withdrawn and combined with the pyrolysis oil withdrawn from the wet electrostatic precipitator 9.

Figure 3:
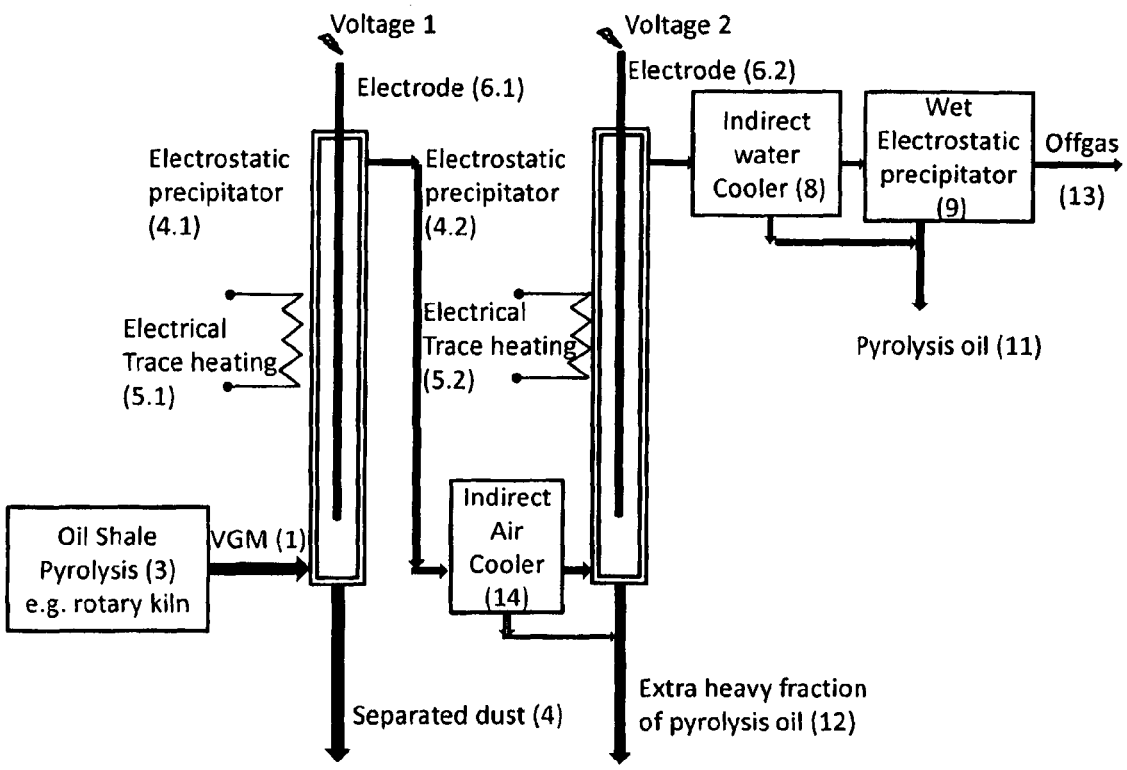
FIG. 3 is a schematic view of an apparatus according to a third embodiment of the present invention.

In the embodiment according to FIG. 3 an additional cooler 11 is provided between the two electrostatic precipitators 4.1 and 4.2.

In the first electrostatic precipitator 4.1 the dust is separated and withdrawn. As in the second embodiment, the electrostatic precipitator 4.1 is operated at a temperature of 380 to 480° C., preferably 400 to 460° C. The VGM then enters the cooler 11, in which it is preferably indirectly cooled with air to a temperature of 310 to 360 ° C. Extra heavy fractions of the oil may be condensed and withdrawn through line 12. In this embodiment the second electrostatic precipitator 4.2 is operated as a wet electrostatic precipitator at a lower temperature between 310 and 360° C. basically corresponding to the exit temperature of the cooler 11.

After the second electrostatic precipitator 4.2 an additional cooler 8, preferably indirectly cooled with water, is provided which cools the VGM to the ambient temperature, preferably about 23° C., prior to introducing it into the wet electrostatic precipitator 9 where the pyrolysis oil is separated and may be withdrawn as product or for further processing. The offgas is discharged through line 13.

The invention will now be further explained by way of examples which are based on research plants according to FIGS. 2 and 3, respectively.

EXAMPLE 1

(Based on FIG. 2)

TABLE 1

| Vapor gas mixture VGM<br>VGM at 430° C. before dedusting<br>Composition of VGM before electrostatic precipitator (4) | |
|---|---|
| H2 | 3.4 g/h |
| Methane | 16 g/h |
| CO | 28 g/h |
| CO2 | 7 g/h |
| Ethylene + Ethane | 19 g/h |
| Propylene + Propane | 16 g/h |
| HC4 to HC6 | 30 g/h |
| water | 220 g/h |
| Pyrolysis oil, condensable at 23° C. | 550 g/h |
| Dust content | approx. 52 g/h |

The vapor gas mixture (VGM) is produced by pyrolysis of oil shale type I. The mass flow of main components of VGM is found in table 1, The VGM stream enters at 430° C. two successive tubular type electrostatic precipitators, 4.1 and 4.2. The dimensions of the tubes of both ESPs are Ø60.3×2.9 mm, the material is stainless steel. Both tubes are electrically earthed. The applied voltage to the electrodes 6.1 and 6.2 is controlled between 5 kV to 20 kV. The tubes of the ESPs are heated from the outside by electrical trace heaters 5.1 and 5.2, respectively and the wall temperature is controlled at 430° C. Every 15 min the ESPs are cleaned by mechanical rapping and the separated dust is collected in a glass bottle. The dust collected during the test was 52 g/h. After the VGM was cleaned from dust by the two electrostatic precipitators, it is cooled down by indirect water cooling (cooler 8) to 23° C. and final oil mist is separated from the gas stream by a wet electrostatic precipitator (9). The pyrolysis oil stream of 550 g/h is collected in a glass bottle. The dust content of the oil was measured and is 30 ppm (=0.003 wt.-%).

EXAMPLE 2

(Based on FIG. 3)

TABLE 2

| Vapor gas mixture VGM<br>VGM at 430° C. before dedusting<br>Composition of VGM before electrostatic precipitator (4) | |
|---|---|
| H2 | 2.3 g/h |
| Methane | 16 g/h |
| CO | 7 g/h |
| CO2 | 40 g/h |
| Ethylene + Ethane | 21 g/h |
| Propylene + Propane | 19 g/h |
| HC4 to HC6 | 21 g/h |
| water | 205 g/h |
| Pyrolysis oil, condensable at 23° C. | 440 g/h |
| dust content | approx. 37 g/h |

The vapor gas mixture (VGM) is produced by pyrolysis of oil shale type II. The composition of the VGM is found in table 2, The VGM stream enters the first tubular type electrostatic precipitator 4.1 at 430° C. The applied voltage to the electrodes is controlled between 5 kV and 30 kV. The tube of the first electrostatic precipitator 4.1 is heated from the outside by an electrical trace heater 5.1 and the wall temperature is controlled to 430° C. Every 15 min the ESP 4.1 is cleaned by mechanical rapping and the separated dust is collected in a glass bottle. The dust collected during the test was 37 g/h.

After the first ESP 4.1 the VGM is cooled down by an indirect air cooler 11 to a temperature of 315° C. The VGM enters then a second ESP 4.2. The tube of the second ESP 4.2 is heated from outside by the electrical trace heater 5.2 and the wall temperature is controlled at 315° C. The oil mist and the remaining dust which was not collected by the first ESP 4.1 are separated in the second ESP 4.2. The second ESP is operated as a wet ESP. The oil fraction together with remaining dust flows down the ESP tube and is collected in a glass bottle. No mechanical rapping is required for the second ESP 4.2. An extra heavy fraction of pyrolysis oil of 30 g/h (7 wt.-% of total collected oil) with dust content of 100 ppm was collected from ESP 4.2. After the second ESP 4.2 the VGM is cooled down by indirect water cooling 8 to 23° C. and final oil mist is separated from the remaining gas stream by a wet ESP 9 operated at 23° C. The pyrolysis oil stream of 410 g/h (93 wt.-% of total collected oil) is collected in a glass bottle. The dust content of this oil stream was measured and is <10 ppm (<0.001 wt.-%).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMBERS

1 electrostatic precipitator
2 rectification device
3 rotary kiln
4 electrostatic precipitator
5 electric trace heater
6 electrodes
7 line
8 cooler

9 wet electrostatic precipitator
10 line
11 cooler
12 line
13 line
ESP electrostatic precipitator
VGM vapor gas mixture

The invention claimed is:

1. A process for dedusting a dust laden vapor gas mixture (VGM) obtained by pyrolysis of a material containing hydrocarbons, the process comprising:

treating the dust laden VGM in a dry electrostatic precipitator at a temperature in a range from 380 to 480° C. so as to separate dust from the VGM; and after removal of the dust in the electrostatic precipitator:

cooling the VGM;

directing the VGM to at least one further electrostatic precipitator; and treating the VGM in the at least one further electrostatic precipitator at a temperature selected so as to separate a predetermined fraction of the oil.

2. The process according to claim 1, wherein the dust laden VGM is obtained from the pyrolysis of oil shale.

3. The process according to claim 1, wherein the VGM is obtained by the pyrolysis of a material containing 8 to 80% by weight of hydrocarbons.

4. The process according to claim 1, wherein the VGM comprises 40-90% by weight of $C_{5+}$hydrocarbons, 4.5-40% by weight of $C_{4-}$hydrocarbons, 0.01-30% by weight of non condensable fractions and 2-30% by weight of water.

5. The process according to claim 1, wherein the dust content of the dust laden VGM is in a range from 3 to 300 g/Nm3.

6. The process according to claim 1, wherein the temperature of the at least one further electrostatic precipitator is in the range from 380 to 480° C.

7. The process according to claim 1, wherein the cooling is performed by at least one of indirect cooling and introducing additional oil.

8. The process according to claim 7, further comprising treating the cooled VGM in a wet electrostatic precipitator at a temperature between 310 and 360° C.

9. The process according to claim 1, further comprising, in at least one of the cooling and a treating of the cooled VGM in a wet electrostatic precipitator at a temperature between 310 and 360° C., separating a heavy oil fraction from the VGM.

10. The process according to claim 1, wherein the VGM is cooled to a temperature between 310 and 360° C.

11. An apparatus for dedusting a vapor gas mixture (VGM) obtained by pyrolysis of a material containing hydrocarbons in accordance with claim 1, the apparatus comprising:

at least one electrostatic precipitator configured to operate at a temperature in a range from 380 to 480° C. so as to separate dust from the VGM;

a cooler disposed downstream of the electrostatic precipitator; and a rectification device disposed downstream of the at least one electrostatic precipitator, the rectification device including at least one further electrostatic precipitator each of which is in combination with a further cooler configured to adjust the temperature of the VGM entering a respective one of the at least one further electrostatic precipitator.

12. The apparatus according to claim 11, further comprising a wet electrostatic precipitator disposed downstream of the cooler.

* * * * *